United States Patent [19]

Klinger

[11] Patent Number: 4,524,871

[45] Date of Patent: Jun. 25, 1985

[54] RECEPTACLE FOR CONTAINING DISPOSABLE CLOTHS AND A STICK-LIKE CONTAINER

[76] Inventor: Max H. Klinger, Obere Ringstrasse 54, 4901 Hiddenhausen, Fed. Rep. of Germany

[21] Appl. No.: 515,512

[22] Filed: Jul. 20, 1983

[30] Foreign Application Priority Data

Jul. 22, 1982 [DE] Fed. Rep. of Germany ... 8220848[U]

[51] Int. Cl.[3] ..... B65D 37/00

[52] U.S. Cl. ..... 206/233; 206/38; 206/581; 206/823; 229/27

[58] Field of Search ..... 206/5, 5.1, 37, 38, 206/45.14–45.19, 85–89, 233, 235, 277, 472–475, 581, 45.31, 491, 823; 229/6 R, 15, 27

[56] References Cited

U.S. PATENT DOCUMENTS

| | | | |
|---|---|---|---|
| 477,215 | 6/1892 | Lowengrund | 206/449 |
| 735,681 | 8/1903 | Stonebridge | 206/38 |
| 1,648,565 | 11/1927 | Primley | 206/38 |
| 1,743,512 | 1/1930 | Aisen | 206/233 |
| 2,167,926 | 8/1939 | Glasker | 206/581 |
| 2,240,811 | 5/1941 | Snelling | 206/45.14 |
| 2,619,226 | 11/1952 | Adams | 206/449 |
| 2,913,101 | 11/1959 | Daily | 206/45.19 |
| 2,980,242 | 4/1961 | Miller | 206/45.31 |
| 3,043,487 | 7/1962 | Fowle | 229/6 R |
| 4,131,195 | 12/1978 | Worrell, Sr. | 206/233 |

FOREIGN PATENT DOCUMENTS

| | | | |
|---|---|---|---|
| 899958 | 6/1962 | United Kingdom | 150/36 |

*Primary Examiner*—George E. Lowrance
*Assistant Examiner*—Jimmy G. Foster
*Attorney, Agent, or Firm*—Wegner & Bretschneider

[57] ABSTRACT

Receptacle for containing disposable cloths and a stick-like container, particularly a liquid cleaner for cleaning spectacles or a lipstick with a one-piece, box-like arrangement comprising a parallelepipedic box (10) for containing the disposable cloths (12) with an opening (14) for the removal thereof; a pace (16) following onto the same for receiving the liquid cleaner or lipstick located in a stick-like container; and a lid (20) closing box (10) and space (16) and a blank for such a receptacle.

4 Claims, 2 Drawing Figures

RECEPTACLE FOR CONTAINING DISPOSABLE CLOTHS AND A STICK-LIKE CONTAINER

Figure 1:
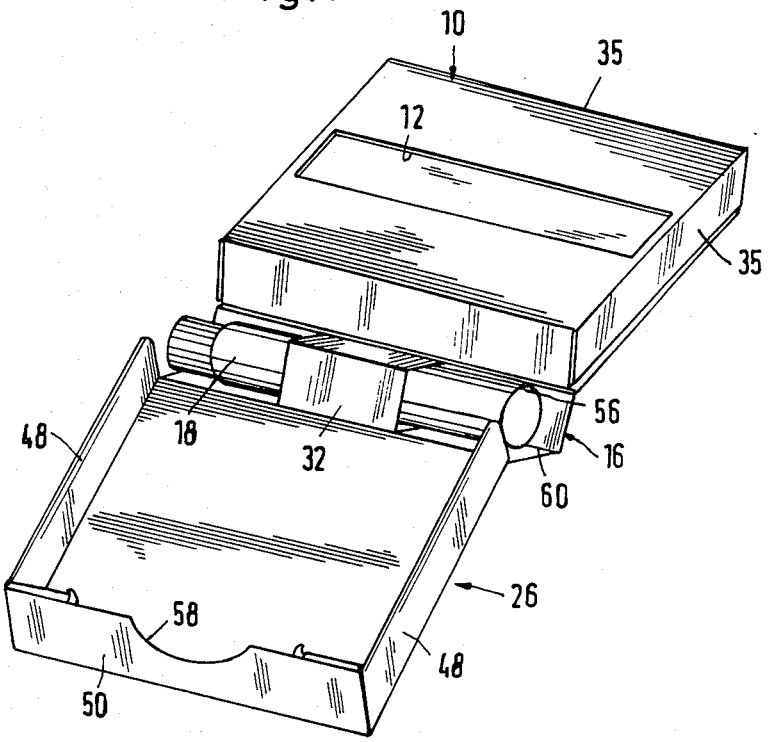

The invention relates to a receptacle for containing disposable cloths and a stick-like container, for example a liquid cleaner for cleaning spectacles or a lipstick, as well as a blank for such a receptacle.

Spectacle lenses are usually cleaned by applying a liquid cleaner to the lenses and the latter are then rubbed by means of small paper cloths made from non-woven material or the like. Small bottles with corresponding liquid cleaners have been available for a considerable time and also long-known paper handkerchiefs are normally used for rubbing purposes.

Disposable paper cloths or handkerchiefs are also widely used when putting on make-up, in that after applying lipstick, the lips are firmly pressed against such a paper cloth, which evens out the applied coating and partly removes it again.

In both cases, the problem arises that both the stick-shaped container and the paper cloths must be used in immediate succession and this is facilitated, if they are housed in an easily accessible receptacle.

The problem of the present invention is to provide a receptacle, which contains in an easily accessible manner e.g. a liquid cleaner for cleaning spectacles or a lipstick and disposable cloths.

According to the invention, this problem is solved by a one-piece, box-ike arrangement, comprising a parallelepipedic box for containing the disposable cloths with an opening for the removal thereof, a following space for containing the stick-like container and a lid closing the box and the space.

According to a preferred embodiment, the opening for removing the disposable cloth is in the form of a slot arranged in the middle of the upper surface of the box and whose width corresponds approximately to one third thereof. In the case of such an opening for the removal of the disposable cloths, the latter can be inserted into the box in the form of a so-called Z-fold, so that after removing a cloth, the next cloth is ready to grip.

Moreover, the space for receiving the stick-like container can be defined on one side by one of the side walls of the box, on the second and third sides by an extension of the lower base surface of the box and on the fourth side by the lid. In addition, the space for containing the stick-like container on the two front faces is formed only by the inwardly flat side walls of the closed lid.

Preferably, the central area of the extension of the lower base surface of the box forming the second and third sides of the space for receiving the stick-like container is constructed as an inwardly pressed-in fastening member. As a result of this construction of the space for receiving the stick-like container, it is ensured that on opening the lid, it is available for user access, but remains fixed due to the clamping action of the retaining member.

The construction of the blank for such a receptacle proposed by the present invention is characterized by a first portion forming the upper base surface of the box, with a centrally arranged recess constituting the opening for removing the disposable cloth and with tongues representing the front faces of the box and separated by hinge lines; a second portion forming the lower base surface of the box and with lateral flaps separated by hinge lines and representing pressing tongues; a first web linking the first portion and the second portion, separated therefrom by hinge lines and forming the side wall remote from the space; a third portion forming the lid and with lateral tongues separated by hinge lines and forming the lid side walls and lid end wall; and a second web linking the second portion and the third portion, separated therefrom by hinge lines and provided with two cuts at right angles to the hinge lines.

Further features and advantages of the invention can be gathered from the claim, the description and drawings, wherein show:

FIG. 1 a perspective view of the receptacle according to the invention for containing disposable cloths and stick-like containers.

Figure 2:
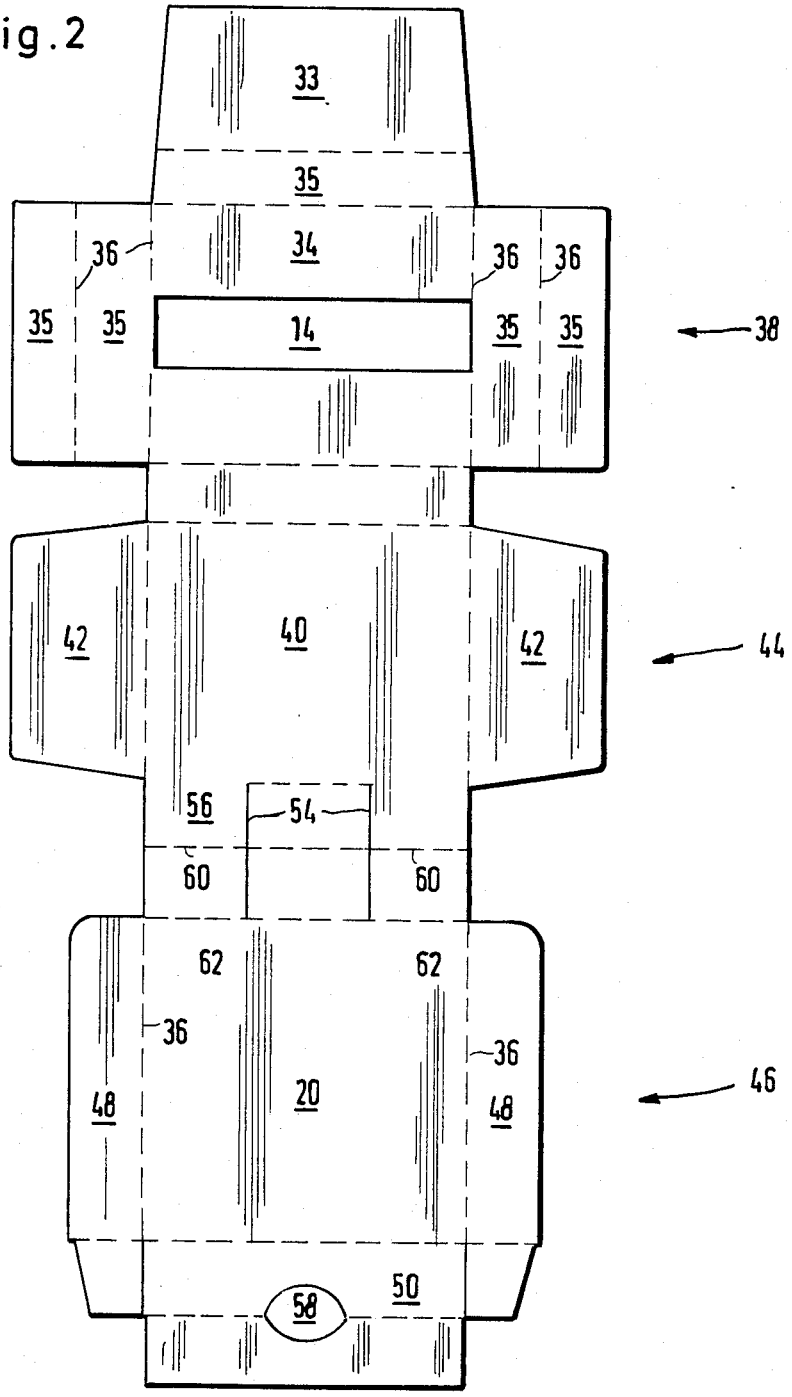

FIG. 2 a plan view of the blank according to the invention.

FIG. 1 illustrates the parallelepipedic box 10 which receives the disposable cloths or handkerchiefs 12 and is provided with an opening 14, from which the cloths or handkerchiefs can be individually removed. Through arranging opening 14 in the center of the upper base surface of box 10, it is ensured that in the case of a Z-fold of the individual disposable cloths, after removing one cloth, the next cloth is available for removal. Box 10 is followed by a space 16, which receives a stick-like container 18, which contains the liquid cleaner or lipstick. In the upper and lower regions, this container engages with a web, which is bent downwards in this area. A central region of the second web 56 forms an upwardly bent retaining member 32, so that the stick-like container is secured between the upper and lower parts of the second web 56 on the one hand and the retaining member 32 on the other. The second web 56 is followed by the lid 20, which is provided with inwardly bent side walls 30 and a front face 28. Front face 28 is provided with a grip recess 58, which facilitates opening the lid when the receptacle is closed.

When the receptacle is closed, the box 10 and the stick-like container 18 in space 16 are completely covered by lid 20. The stick-like container 18 is prevented from falling out by side walls 30 on lid 20. However, when lid 20 is raised, both the disposable cloths 12 and the stick-like container 18 for the liquid container or lipstick are available for user access.

FIG. 2 is a plan view of the blank for such a receptacle. The first portion 38 forms the upper base surface of the box, which contains an opening 14, which gives access to the Z-folded disposable cloths. Laterally are provided tongues 35, which are provided with hinge lines 36 and form the side walls 22 of box 10. A flap 33 projects upwards and its lower part forms the front face 35 of box 10. The upper part of flap 33 is placed on the lower base surface 40 formed by the second portion 44 of the blank, so that the inwardly bent flaps 42 are pressed upwards against the disposable cloths 12 placed in box 10, which ensures their accessibility through opening 14. Between the first portion 38 and the second portion 44 is located a first web, separated with respect to the first portion 38 and the second portion 44 by in each case one hinge line 36. The third portion 46 forms the lid 20, which can be pivoted along the hinge line 62 for closing the receptacle. After bending inwards, tongues 48 separated by hinge lines 36 form the lid side walls, whilst a further tongue forms the lid end wall 50. The latter has a double thickness and is provided with a grip recess 58, which facilitates the opening of the lid. Between the second portion 44 and the third portion 46 is provided a second web 56, which is provided with a hinge line 60 and forms two sides of space 16 receiving bottle 18. Cuts 54 mark the retaining members 32, which are forced upwards out of the plane of the drawing and secure the stick-like container.

The features disclosed in the above description, the drawings and the claims can be vital for the realisation of the invention in its various embodiments, either singly, or in random combinations.

I claim:

1. A receptacle for containing disposable cloths and a tubular container, comprising:

a parallelepipedic box for containing disposable cloths, having a base and an upper surface with an opening;

a lid having sidewalls for closing the box;

a connecting member adjacent to a first sidewall of said box, hingedly connecting the base of said box to said lid;

a space for accepting a tubular container, defined by at least said first sidewall and said connecting member, said space having end openings closable by portions of the sidewalls of said lid; and means for retaining a tubular container in said space, comprising a forced-in central segment of said connecting member.

2. A receptacle according to claim 1, wherein the opening in the upper surface of said box is a gap in the upper surface, having a width which is about one third of the dimension of the upper surface in the same direction.

3. A receptacle according to claim 1, further comprising pressure means on the base of said box for forcing cloths in said box toward said opening.

4. A blank for forming the receptacle of claim 3, comprising:

an apertured first portion for forming the upper surface of the box;

a first plurality of hinged tongues extending from three sides of said first portion for forming sidewalls of the box;

a second portion for forming the base of the box;

a plurality of hinged flaps extending from the sides of said second portion for forming pressure tongues inside the box;

a first web hingedly connecting said first and second portions, for forming one sidewall of the box;

a third portion for forming the lid of the receptacle;

a second plurality of hinged tongues extending from three sides of said lid for forming the sidewalls of said lid; and a second web hingedly connecting said second and third portions for forming the connecting member, scored with two cuts substantially perpendicular to the hinge connection of said second web for forming said means for retaining.

* * * * *